US008995849B2

(12) United States Patent
Ota

(10) Patent No.: US 8,995,849 B2
(45) Date of Patent: Mar. 31, 2015

(54) PRINTING APPARATUS WHICH SWITCHES A PRINTING MODE UPON RESUMING AFTER A JAM

(75) Inventor: Yuichi Ota, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 65 days.

(21) Appl. No.: 13/242,465

(22) Filed: Sep. 23, 2011

(65) Prior Publication Data

US 2012/0093525 A1 Apr. 19, 2012

(30) Foreign Application Priority Data

Oct. 19, 2010 (JP) ..... 2010-234281

(51) Int. Cl.
*G03G 15/00* (2006.01)
*B41J 11/00* (2006.01)
(Continued)

(52) U.S. Cl.
CPC ..... *B41J 11/006* (2013.01); *B41J 13/0009* (2013.01); *G03G 15/234* (2013.01); *G03G 15/70* (2013.01); *B65H 2511/414* (2013.01); *B65H 2511/528* (2013.01); *B65H 2513/42* (2013.01); *G03G 2215/00548* (2013.01); *G03G 2215/00599* (2013.01); *G03G 2215/00949* (2013.01)
USPC ..... 399/21; 399/19; 271/258.04; 271/259

(58) Field of Classification Search
CPC ..... B41J 11/006; B65H 7/06; B65H 2601/11; G03G 15/70; G03G 15/706; G03G 15/5012; G03G 2215/00548
USPC ..... 399/18, 19, 21; 271/258.01, 258.04, 271/259
See application file for complete search history.

(56) References Cited

U.S. PATENT DOCUMENTS 5,374,045 A 12/1994 Milillo
2003/0020228 A1* 1/2003 Kobayashi et al. ..... 271/3.14
2004/0207708 A1 10/2004 Ohashi et al.
(Continued)

FOREIGN PATENT DOCUMENTS

CN 1114947 A 1/1996
CN 1539647 A 10/2004
(Continued)

OTHER PUBLICATIONS

Notice of Reasons for Rejection dated Jan. 8, 2013 received from the Japanese Patent Office from related Japanese Application No. 2010-234281, together with an English-language translation.
(Continued)

*Primary Examiner* — Blake A Tankersley
(74) *Attorney, Agent, or Firm* — Scully, Scott, Murphy & Presser PC

(57) ABSTRACT

A printing apparatus includes a print mechanism which performs a printing on a plurality of papers; a paper feed section on which the papers to be printed are placed; a paper discharge section on which the papers that have been printed are placed; a transport route which extends from the paper feed section to the paper discharge section via a printing position at which the printing is performed by the print mechanism; a transport mechanism which successively transports the papers along the transport route; and a controller which controls the transport mechanism. The controller controls the transport mechanism to perform a transportation of the papers by a plurality of transport modes including a first transport mode and a second transport mode.

9 Claims, 11 Drawing Sheets

(51) Int. Cl.
*B41J 13/00* (2006.01)
*G03G 15/23* (2006.01)

(56) References Cited

U.S. PATENT DOCUMENTS

| | | | | |
|---|---|---|---|---|
| 2008/0224387 | A1* | 9/2008 | Tamagaki | 271/227 |
| 2008/0231881 | A1* | 9/2008 | Karasawa | 358/1.15 |
| 2009/0141298 | A1 | 6/2009 | Kushida | |
| 2009/0317096 | A1 | 12/2009 | Odaira | |

FOREIGN PATENT DOCUMENTS

| | | | | | |
|---|---|---|---|---|---|
| CN | 101134537 | A | | 3/2008 | |
| CN | 101271298 | A | | 9/2008 | |
| CN | 101446786 | A | | 6/2009 | |
| JP | 63-160941 | | | 7/1988 | |
| JP | H04-162073 | | | 6/1992 | |
| JP | 11-284818 | | | 10/1999 | |
| JP | 2001-063152 | | | 3/2001 | |
| JP | 2009-292557 | | | 12/2009 | |
| JP | 2010-1151 | | | 1/2010 | |
| JP | 2010066778 | | * | 3/2010 | G03G 21/00 |

OTHER PUBLICATIONS

Chinese Office Action dated Nov. 11, 2013 in counterpart Chinese Patent Application No. 201110309899.1.

* cited by examiner

PRINTING APPARATUS WHICH SWITCHES A PRINTING MODE UPON RESUMING AFTER A JAM

CROSS REFERENCE TO RELATED APPLICATION

The present application claims priority from Japanese Patent Application No. 2010-234281, filed on Oct. 19, 2010, the disclosure of which is incorporated herein by reference in its entirety.

BACKGROUND OF THE INVENTION

1. Field of the Invention

The present invention relates to a printing apparatus including a transport mechanism which successively transports a plurality of papers to a transport route of the papers so that the papers are present in the transport route.

2. Description of the Related Art

Conventionally, there is known a printing apparatus including a transport mechanism (hereinafter referred to as a "high-speed transport mechanism") which successively transports a plurality of papers to a transport route of the papers so that the papers are present in the transport route. Such a printing apparatus feeds, without waiting a discharge of one paper, the following paper in the apparatus. Thus, the printing apparatus has advantages such that an interval between the papers during transportation of the papers is short and that productivity is excellent.

As the printing apparatus including the high-speed transport mechanism, for example, Japanese Patent Application Laid-open No. H11-284818 discloses a printing apparatus which adopts a double-sided printing. In the double-sided printing, printing is firstly performed on one surface of one paper, is secondly performed on one surface of another paper, and is thirdly performed on the other surface of the one paper. In other words, the printing on one surface of the paper is continuously performed on the plurality of papers.

However, the conventional printing apparatus described above has the following problem. That is, when a paper jam occurs in the printing apparatus including the high-speed transport mechanism, a large number of papers are stayed in the transport route of the apparatus (hereinafter referred to as "staying papers"), thereby complicating a recovery operation. For example, it is assumed a case in which, after resolving the paper jam, a scrap of the paper is stayed in the apparatus. This is likely to cause the paper jam again, thereby causing a trouble such that the large number of the papers has to be removed again from the apparatus.

SUMMARY OF THE INVENTION

The present invention is made for resolving the problem of the conventional printing apparatus described above. That is, an object of the present invention is to provide a printing apparatus which includes a high-speed transport mechanism and prevents any trouble in a recovery operation at the time of a paper jam.

According to an aspect of the present teaching, there is provided a printing apparatus including a print mechanism which performs a printing on a plurality of papers; a paper feed section on which the papers to be printed by the print mechanism are placed; a paper discharge section on which the papers that have been printed by the print mechanism are placed; a transport route which extends from the paper feed section to the paper discharge section via a printing position at which the printing is performed by the print mechanism; a transport mechanism which successively transports the papers along the transport route; and a controller which controls the transport mechanism, wherein the controller controls the transport mechanism to perform a transportation of the papers by a plurality of transport modes including a first transport mode and a second transport mode, the first transport mode being a mode in which the transport mechanism transports the papers so that up to first number of the papers are present in the transport route, the second transport mode being a mode in which the transport mechanism transports the papers so that up to second number, which is smaller than the first number, of the papers are present in the transport route; and in a case that a paper jam occurs in the transport route during the transportation of the papers by the first transport mode to thereby discontinue the transportation of the papers, the controller controls the transport mechanism to resume the transportation of the papers by switching the transport modes from the first transport mode to the second transport mode.

The printing apparatus of the present teaching includes the transport mechanism which successively transports the papers along the transport route and supports the at least two transport modes (the first transport mode, the second transport mode) having different maximum numbers of the papers presented in the transport route (hereinbelow referred to as a "maximum number of papers to be transported") from each other. The maximum number of the papers to be transported in the first transport mode is larger than the maximum number of the paper(s) to be transported in the second transport mode. The first transport mode is capable of successively transporting the plurality of papers so that two or more papers are present in the transport route. The maximum number of the paper(s) to be transported in the second transport mode is only necessary to be smaller than the maximum number of the papers to be transported in the first transport mode. Therefore, in the second transport mode, the maximum number of the paper(s) to be transported may be one. The maximum number of the paper(s) to be transported in the second transport mode may be two or more, provided that the maximum number of the papers to be transported in the first transport mode is not less than three. Further, the transport mechanism itself of the printing apparatus of the present teaching may support either a single-sided printing only or the double-sided printing. In the printing apparatus of the present teaching, in a case that the paper jam occurs in the transport route during the transportation of the papers by the first transport mode to thereby discontinue the transportation of the papers, the first transport mode is switched to the second transport mode so as to resume the transportation of the paper(s).

That is, in the printing apparatus of the present teaching, in a case that the paper jam occurs during the transportation of the papers by the first transport mode having the large maximum number of the papers to be transported, the transportation of the paper(s) is resumed, upon completion of the recovery operation, by the second transport mode having the maximum number of the paper(s) to be transported which is smaller than the maximum number of the papers to be transported in the first transport mode. By doing so, even when the paper jam recurs after resumption of the transportation of the paper(s) by the second transport mode, the number of the staying paper(s) is smaller as compared with the first transport mode. Therefore, it is possible to reduce any trouble in the recovery operation.

According to the present teaching, there is realized a printing apparatus which includes a high-speed transport mechanism and prevents any trouble in a recovery operation at the time of a paper jam.

DESCRIPTION OF THE PREFERRED EMBODIMENTS

An explanation will be made in detail with reference to the accompanying drawings about embodiments in which a printing apparatus according to the present teaching is embodied. In this embodiment, the present teaching is applied to a printer in which a printing on a first surface of the paper is continuously performed on two sheets and then the printing on a second surface is performed, when performing a double-sided printing.

Figure 1:
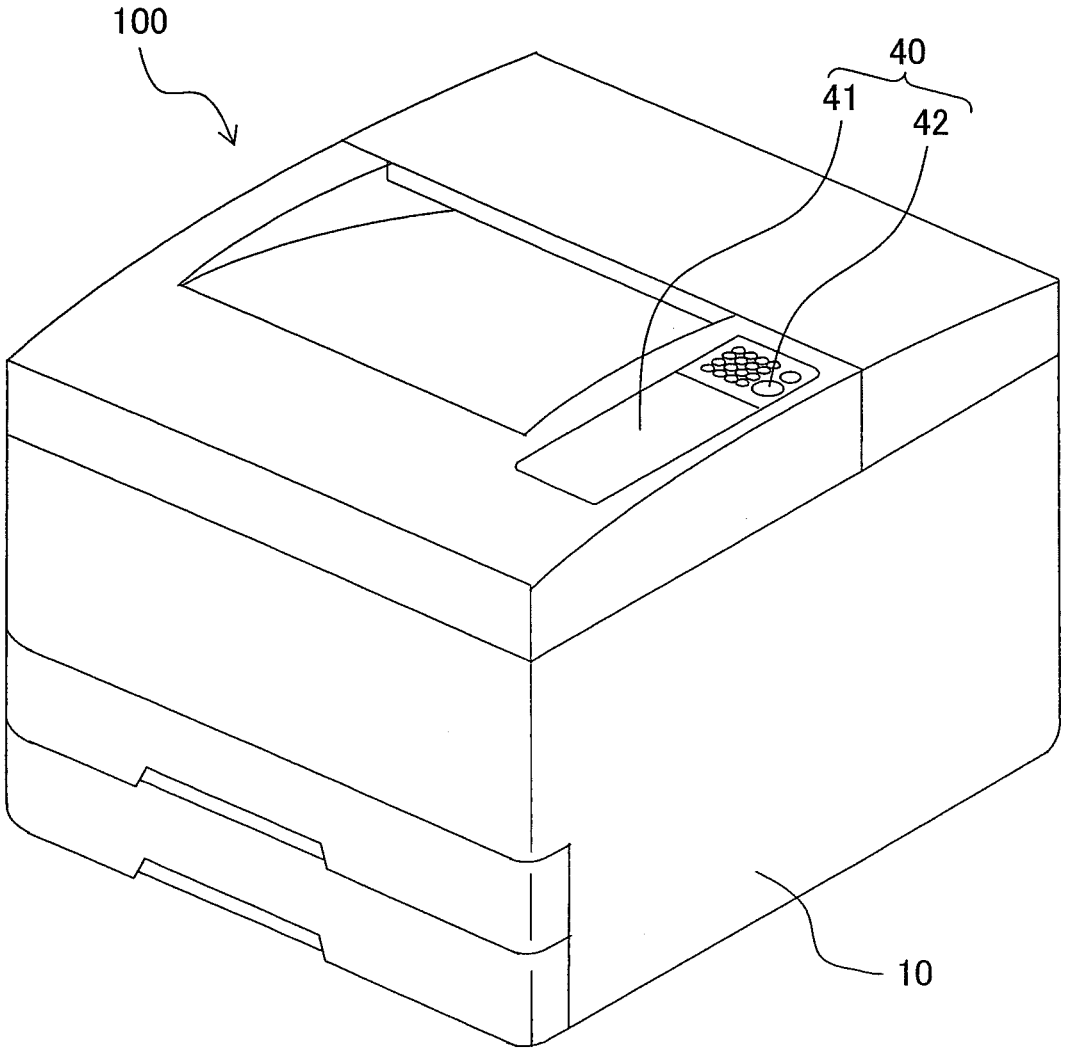
FIG. 1 is a perspective view of a schematic structure of a printer according to an embodiment.

As shown in FIG. 1, a printer 100 of the embodiment is provided with a body portion 10 which forms an image on a paper and an operation panel 40 which is placed on an upper surface of the body portion 10 and includes a display section 41 and a button group 42, the display section 41 being constructed of a liquid crystal display, the button group 42 being constructed of a start key, a stop key, a numerical key pad, etc. It is possible to display an operation state on the operation panel 40 and it is possible for a user to perform an input operation through the operation panel 40.

Figure 2:
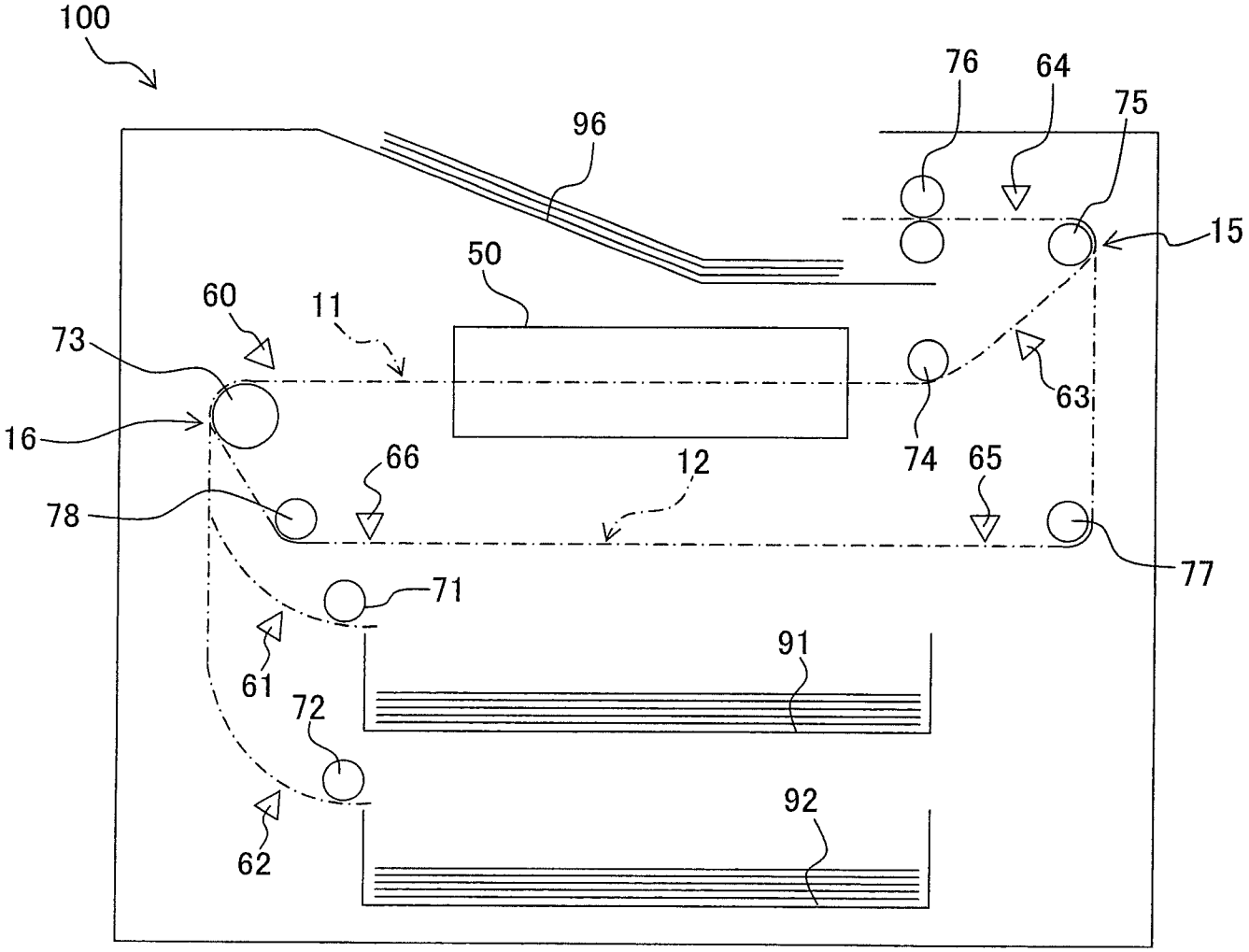
FIG. 2 conceptually shows an internal structure of the printer shown in FIG. 1.
Figure 3A:
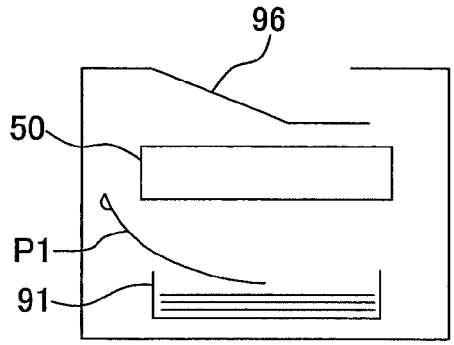
FIGS. 3A to 3H conceptually show an operation procedure of a high-speed double-sided printing.
Figure 3B:
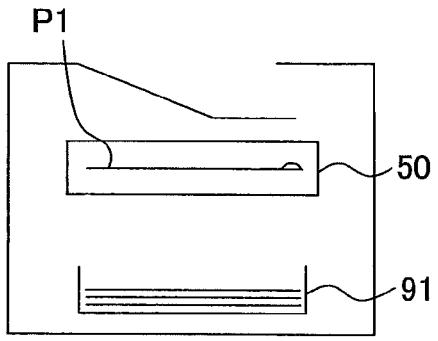
Figure 3C:
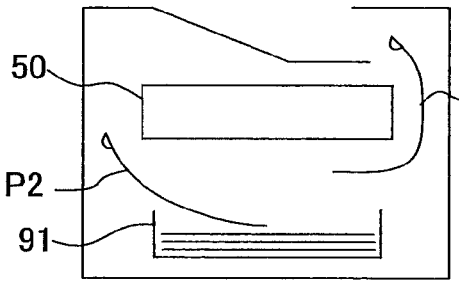
Figure 3D:
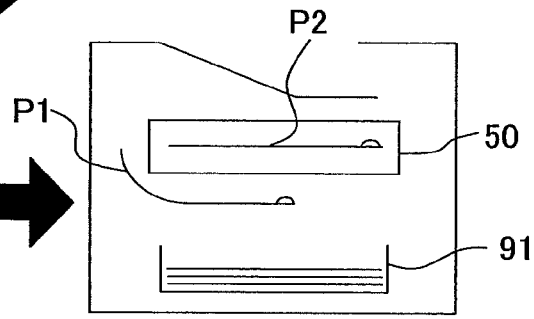
Figure 3E:
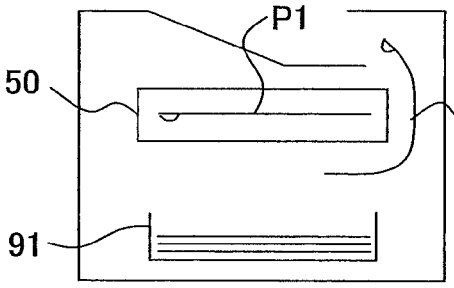
Figure 3F:
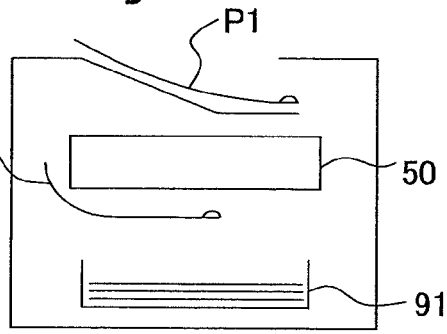
Figure 3G:
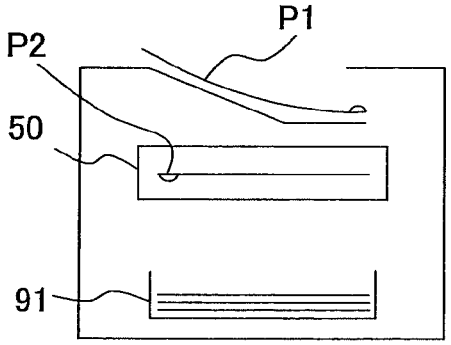
Figure 3H:
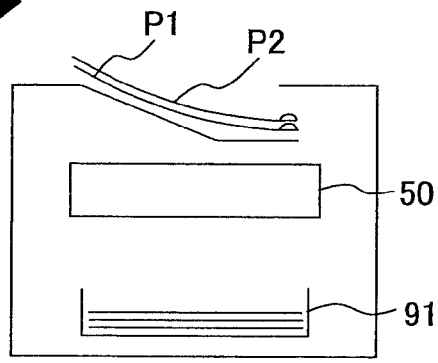

FIG. 2 shows an internal structure of the printer 100. As shown in FIG. 2, the printer 100 is provided with a process section 50 (an example of a print mechanism) which forms a toner image in accordance with a well-known electro-photographic manner, paper feeding cassettes 91, 92 (examples of a paper feed section) on which papers to be printed are placed, a paper discharge tray 96 (an example of a paper discharge section) on which the papers that have been printed are placed, paper sensors 60, 61, 62, 63, 64, 65, 66 (examples of an identification mechanism) which detect passing of the paper, paper feeding rollers 71, 72, paper discharge rollers 76, and transporting rollers 73, 74, 75, 77, 78. That is, a transport route, which extends from the paper feeding cassettes 91, 92 to the paper discharge tray 96 via a printing position in the process section 50, is formed in the printer 100. The papers are successively transported, along the transport route, by the paper feeding rollers 71, 72, the transporting rollers 73, 74, 75, 77, 78, and the paper discharge rollers 76. The paper feeding rollers 71, 72, the paper discharge rollers 76, and the transporting rollers 73, 74, 75, 77, 78 are examples of the transport mechanism.

Further, the printer 100 is provided with a substantially S-shaped printing route 11 (alternate long and short dash lines in FIG. 2) so that the papers accommodated in the paper feeding cassette 91 (or paper feeding cassette 92) placed on the bottom portion are successively introduced to the paper discharge tray 96 placed on the upper portion via paper discharge rollers 76 upon passing through the paper feeding roller 71 (or the paper feeding roller 72), the transporting roller 73, the process section 50, and the transporting rollers 74, 75.

In the printer 100 of the embodiment, the papers placed in the paper feeding cassette 91 (or the paper feeding cassette 92) are taken one by one. The paper is transported to the process section 50, and the toner image fainted in the process section 50 is transferred onto the paper. Further, the paper having the toner image transferred thereon is transported to a fixing device in the process section 50, and the toner image is thermally fixed onto the paper. Thereafter, the paper with the toner image fixed thereon is discharged on the discharge tray 96.

The paper sensor 60 is arranged on the downstream side of the paper feeding roller 71 and on the upstream side of the process section 50, in the transporting direction of the papers. The paper sensor 60 detects as to whether or not the paper passes through a predetermined position of the printing route 11. That is, the printer 100 is capable of detecting that a front end of the paper passes through the paper sensor 60 when an output signal from the paper sensor 60 is switched from "No paper" to "Having paper". The printer 100 is capable of detecting that a rear end of the paper passes through the paper sensor 60 when the output signal from the paper sensor 60 is switched from "Having paper" to "No paper". The printer 100, for example, detects the passing of the rear end of the paper based on the output signal from the paper sensor 60 and determines a timing for feeding the following paper upon detection of the rear end of the paper.

The printer 100 is provided with a reverse-transport mechanism to perform the double-sided printing. A re-transport route 12 (two-dot lines in FIG. 2) is a transport route in which the paper that has been printed on the first surface (one surface) is reversed and re-transported to the process section 50 so as to perform the printing on the second surface (the other surface). The re-transport route 12 branches at a branch point 15 from the printing route 11, the branch point 15 being arranged on the downstream side of the process section 50 and on the upstream side of the paper discharge rollers 76, in the transporting direction of the papers. The re-transport route 12 starts at the branch point 15, passes through the transporting rollers 77, 78 disposed between the process section 50 and the paper feeding cassette 91, and merges with the printing route 11 at a merging point 16 arranged on the upstream side of the process section 50 of the printing route 11.

In particular, in the double-sided printing by the printer 100, the paper is reversed in accordance with the following process. At first, the paper having passed through the printing route 11 and having the image formed on the first surface is transported up to the paper discharge rollers 76. After the rear end of the paper passes through the branch point 15, the paper discharge rollers 76 once stop while nipping the paper therebetween. Thereafter, a rotating direction of the paper discharge rollers 76 is switched, the transporting direction of the paper is reversed, and the paper is transported to the re-transport route 12. Then, the paper is returned, on the upstream side of the process section 50 of the printing route 11, to the printing route 11. By doing so, the paper is reversed (upside down), the printing is performed on the second surface of the paper.

Further, the printer 100 has a high-speed double-sided printing function for performing the double-sided printing, the high-speed double-sided printing function being a function in which the printing on the first surface of the paper is continuously performed on two sheets and then the printing on the second surface of the paper is continuously performed on the two sheets. In particular, each paper is transported in accordance with the process shown in FIG. 3.

(A) A preceding paper P1, which is the first paper, is fed to the printing route 11.

(B) The printing is performed on the first surface of the preceding paper P1 at the printing position (not shown) in the process section 50.

(C) The preceding paper P1 is transported to the re-transport route 12, and a following paper P2, which is the second paper, is fed to the printing route 11.

(D) The preceding paper P1 is returned to the printing route 11, and the printing is performed on the first surface of the following paper P2 at the printing position in the process section 50.

(E) The printing is performed on the second surface of the preceding paper P1 at the printing position in the process section 50, and the following paper P2 is transported to the re-transport route 12.

(F) The preceding paper P1 is discharged, and the following paper P2 is returned to the printing route 11.

(G) The printing is performed on the second surface of the following paper P2 at the printing position in the process section 50.

(H) The following paper P2 is discharged.

Namely, in the high-speed double-sided printing (an example of the first transport mode) of the printer 100, two papers are successively transported in the transport route to perform the printing in order of the first surface (first paper), the first surface (second paper), the second surface (first paper), the second surface (second paper). As compared with a case in which only one paper is transported in the transport route to perform the printing one-by-one in order of the first surface, the second surface (hereinafter referred to as a "low-speed double-sided printing"; an example of the second transport mode), the transporting process of the high-speed double-sided printing has better printing efficiency, because a standby time of the process section 50 in the high-speed double-sided printing is short. The printer 100 appropriately performs a switching operation between the high-speed double-sided printing and the low-speed double-sided printing, upon performing the double-sided printing.

Further, each of the paper sensors 60 to 66 detects as to whether or not the paper passes through a predetermined position of the printing route 11 (or re-transport route 12). That is, as in the paper sensor 60, each of the paper sensors 61 to 66 is capable of detecting that the front end of the paper passes through the predetermined position when the output signal from each paper sensor is switched from "No paper" to "Having paper". Each of the paper sensors 61 to 66 is capable of detecting that the rear end of the paper passes through the predetermined position when the output signal is switched from "Having paper" to "No paper".

Further, when a paper jam occurs, each of the paper sensors 60 to 66 is utilized for identifying a position (paper jam occurrence position) at which the paper jam occurs. That is, the printer 100 watches the passing of the paper at predetermined points in the printing route 11 and the re-transport route 12, based on the signal from each of the paper sensors 60 to 66. For example, when there occurs a trouble in which the front end of the paper is not allowed to pass through the predetermined point at a timing for the front end of the paper to pass, it is judged that the paper jam occurs at a position between the paper sensor which has detected the trouble and the paper sensor arranged next to and on the upstream side of the paper sensor which has detected the trouble.

The number of paper sensors and their positions are not limited to the example of this embodiment. For example, it is allowable that the number of paper sensors is increased so as to identify the paper jam occurrence position with a high degree of accuracy. Further, it is allowable that the number of paper sensors is decreased so as to reduce costs.

Figure 4:
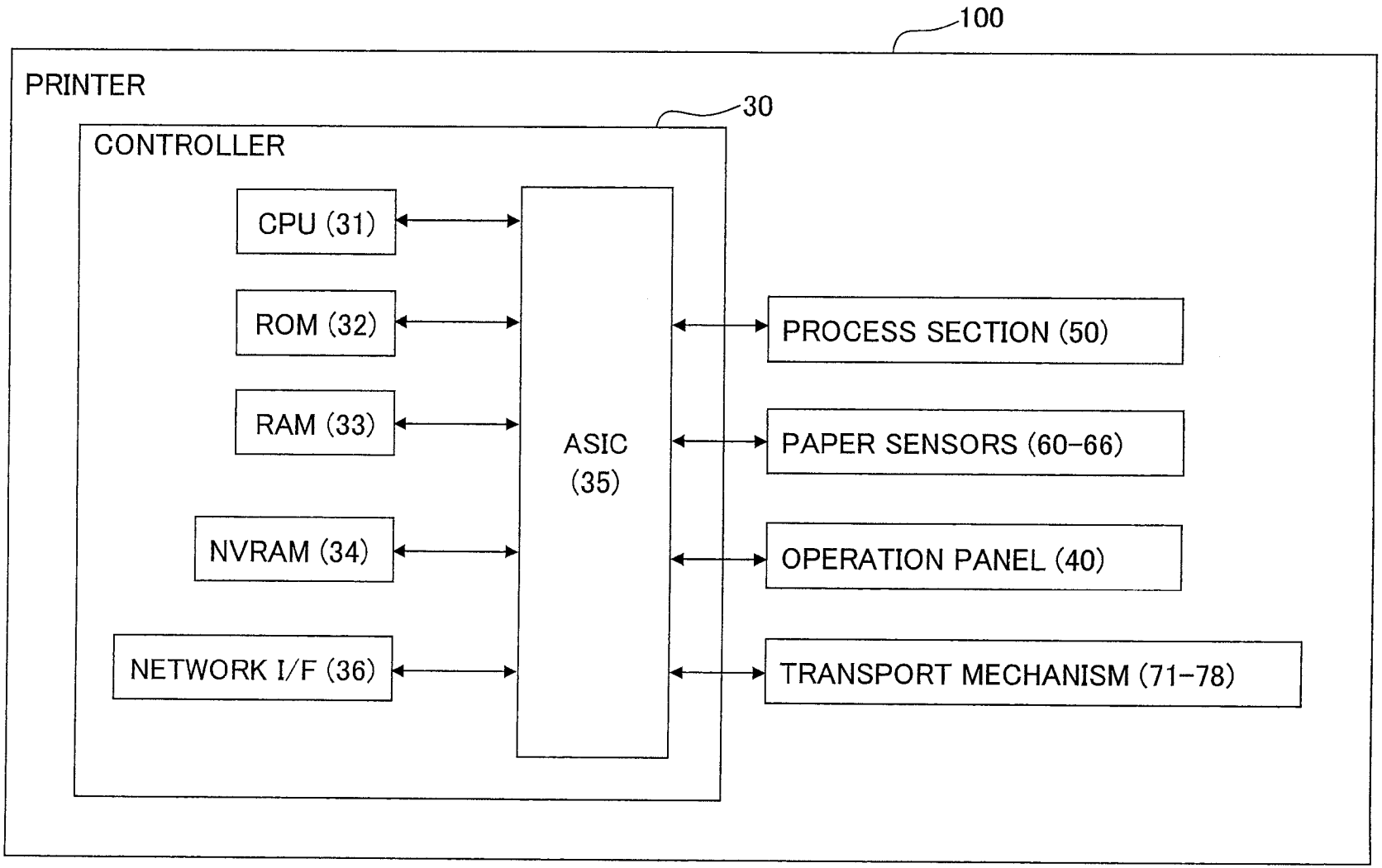
FIG. 4 is a block diagram showing an electrical construction of the printer shown in FIG. 1.

Subsequently, an electrical construction of the printer 100 will be explained. As shown in FIG. 4, the printer 100 is provided with a controller 30 (an example of an identification mechanism) including a CPU 31, a ROM 32, a RAM 33, a NVRAM (nonvolatile RAM) 34, a ASIC 35, and a network interface 36. The controller 30 is electrically connected to the process section 50, the operation panel 40, the paper sensors 60 to 66, the transport mechanisms 71 to 78, etc.

The ROM 32 stores various control programs, various settings for controlling the printer 100, and an initial value, etc. The RAM 33 is utilized as a work area at which the various control programs are read or as a storage area which temporarily stores a piece of image data.

The CPU 31 controls each component (for example, a timing of lighting of an exposure apparatus, a drive motor (not shown) of various rollers 71 to 78 constructing the printing route 11 and the re-transport route 12) of the printer 100 via the ASIC 35, while storing, in the RAM 33 or the NVRAM 34, a processing result processed in accordance with the control program read from the ROM 32 and/or a signal from each of the sensors.

The network interface 36 is connected to a network, such as LAN, thereby making it possible to connect the printer 1 with an external apparatus in which a printer driver for the printer 100 is installed. The printer 100 is capable of performing communication of a printing job via the network interface 36.

Figure 5A:
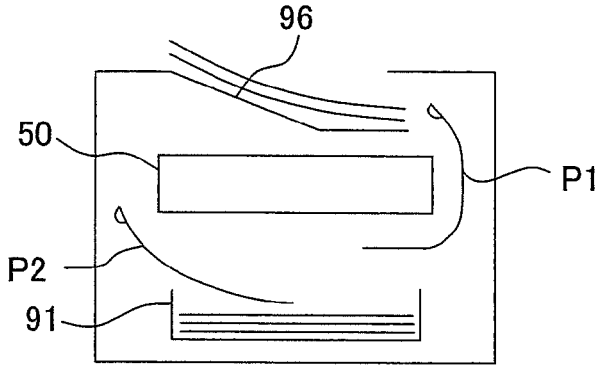
FIGS. 5A to 5D are diagrams showing a switching transition between paper transport modes in a recovery operation from a paper jam.
Figure 5B:
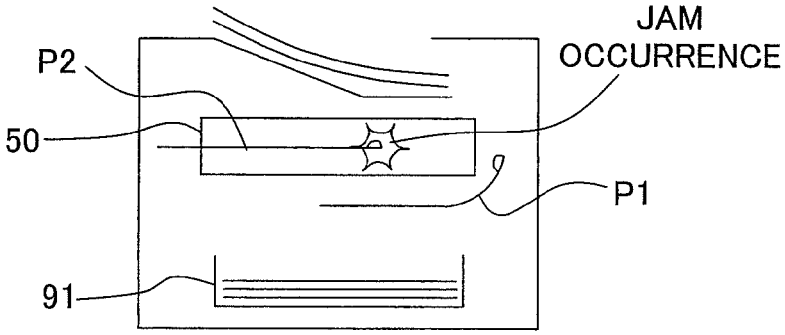

Subsequently, an explanation will be made about a recovery process when the paper jam occurs during the high-speed double-sided printing of the printer 100. In the printer 100 of this embodiment, as shown in FIG. 5A, two papers P1, P2 are transported in the apparatus during the high-speed double-sided printing. When the paper jam occurs during the high-speed double-sided printing, the transportation of the papers is stopped, and as shown in FIG. 5B, the paper which has caused the paper jam and the paper which is placed on the upstream side of the paper jam occurrence position in the transporting direction of the papers are left in the apparatus.

Figure 5C:
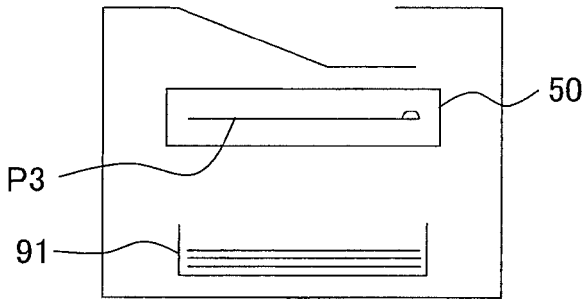
Figure 5D:
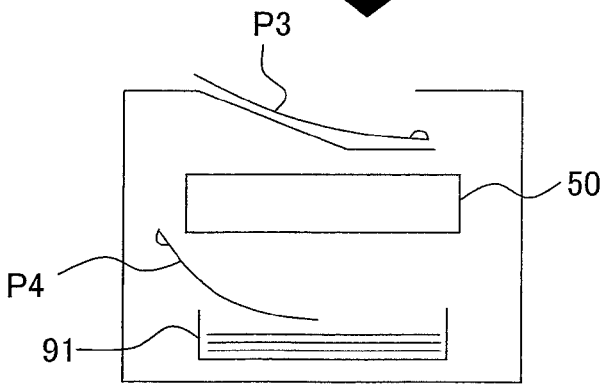

Then, a recovery operation in which staying papers are removed out of the apparatus is performed by the user. The printing is resumed by the low-speed double-sided printing upon completion of the recovery operation. That is, as shown in FIG. 5C, only one paper P3 is transported in the apparatus. After detection of the discharge of the paper P3, the printing is switched to the high-speed double-sided printing. That is, as shown in FIG. 5D, a paper P4, which follows the paper P3, is printed by the high-speed double sided printing.

That is, even after the recovery operation in which the staying papers P1, P2 are removed is completed, a scrap of the paper, etc., which was unsuccessfully removed, is stayed in the apparatus in some cases. In that case, there is high possibility that the paper jam recurs. In view of this, the paper P3, which is transported immediately after the resumption of the transportation of the paper, is printed by the low-speed double-sided printing, and it is checked as to whether the double-sided printing is normally performed from the feeding of the paper to the discharge of the paper. Then, the printing is switched to the high-speed double-sided printing. When the printing is resumed by the low-speed double-sided printing and when the scrap of the paper, etc. is stayed in the apparatus, the paper jam recurs. However, since the paper jam is caused by only the one paper P3, the recovery operation is simple.

The printer 100 stores, in the RAM 33 or the NVRAM 34, the setting as to whether or not the resumption by the low-speed double-sided printing is permitted upon the completion of the recovery operation. In a case that the resumption by the low-speed double-sided printing is not permitted, the printing is resumed by the high-speed double-sided printing. That is, in a case that productivity has priority, the setting is made such that the resumption by the low-speed double-sided printing is unpermitted. The setting may be previously made in the printer 100 before the printing is started, or a setting screen may be displayed on the display section 41 whenever the printer 100 is recovered from the paper jam.

Subsequently, an explanation will be made about a process which realizes the recovery operation from the paper jam, described above. Note that, the process will be explained below while being divided into the operation performed when the occurrence of the paper jam is detected and the operation performed when the transportation of the paper(s) is resumed.

Figure 6:
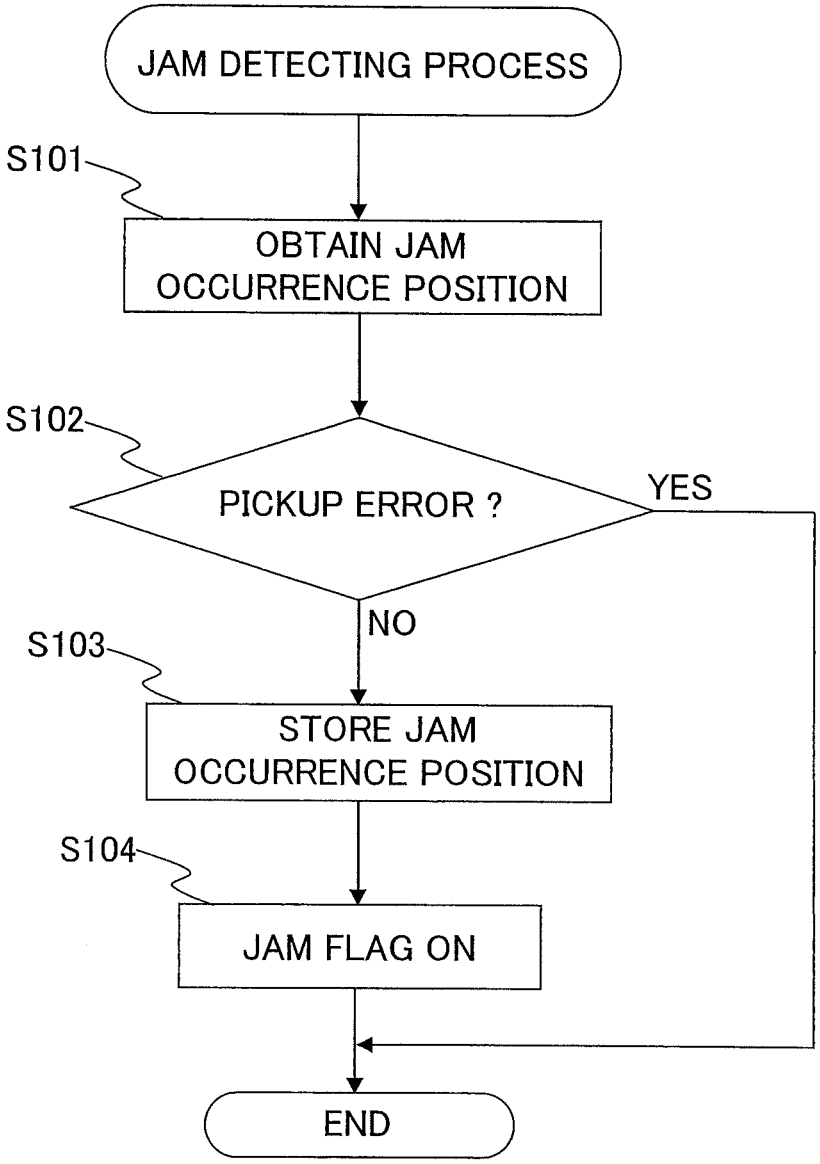
FIG. 6 is a flowchart showing a procedure of a paper jam detecting process.

At first, an explanation will be made about a paper jam detecting process executed by the CPU 31 of the printer 100 with reference to the flowchart shown in FIG. 6. The paper jam detecting process is performed when the paper jam is detected during the high-speed double-sided printing.

At first, information about a paper jam occurrence position is obtained (S101). The paper jam occurrence position is judged based on the signal from each of the paper sensors 60 to 66 placed on the printing route 11 and the re-transport route 12.

For example, when the paper jam is detected by the paper sensor 61, in particular, when the paper is not detected by the paper sensor 61 even after a predetermined time has passed since a pickup instruction to the paper feeding roller 71 for picking up the paper from the paper feeding cassette 91 was made, it can be judged that the paper feeding roller 71 fails to pick up the paper from the paper feeding cassette 91 due to a slip, etc. (hereinafter referred to as a "pick up error"). When the paper jam is detected by the paper sensor 62, the paper jam can be judged as the pickup error in which the paper feeding roller 72 fails to pick up the paper from the paper feeding cassette 92. When the paper jam is detected by the paper sensor 60, it can be judged that the paper jam occurs in the vicinity of resist rollers (not shown) placed just before the process section 50. When the paper jam is detected by the paper sensor 63, it can be judged that the paper jam occurs in the process section 50. When the paper jam is detected by the paper sensor 64, it can be judged that the paper jam occurs in the vicinity of a paper discharge port. When the paper jam is detected by the paper sensor 65, it can be judged that the paper jam occurs in the vicinity of a position at which the paper is transported from the printing route 11 to the re-transport route 12. When the paper jam is detected by the paper sensor 66, it can be judged that the paper jam occurs in the vicinity of a position at which the paper is transported from the re-transport route 12 to the printing route 11.

Subsequently, it is judged as to whether or not the cause of the paper jam is the pickup error based on the position identified in the S101 (S102). In a case that the cause of the paper jam is not the pickup error (S102: No), the position identified in the S101 is stored in the RAM 33 or the NVRAM 34 (S103). Further, a jam flag which stores the occurrence of the paper jam is turned on (S104). An initial value of the jam flag is an "off", and the jam flag is turned on in the S104 whenever the paper jam is detected. When the jam flag is turned on, a switching control to the low-speed double-sided printing, as will be described later on, is performed. After the S104, the paper jam detecting process is completed.

On the other hand, in a case that the cause of the paper jam is the pickup error (S102: Yes), the paper jam detecting process is completed without turning on the jam flag. That is, in the case that the cause of the paper jam is the pickup error, a plurality of papers is not stayed in the printing route 11 (or re-transport route 12). Therefore, it is not likely that the scrap of the paper, etc., is unsuccessfully removed. In view of this, in the case that the cause of the paper jam is the pickup error, the productivity has the priority, and the jam flag for performing the switching control to the low-speed double-sided printing is not turned on.

In the paper jam detecting process, when the paper jam is detected, the jam flag is turned on to store the occurrence of the paper jam, except when the cause of the paper jam is the pickup error. By doing so, when the transportation of the papers is resumed, the printer 100 is capable of recognizing that the transportation of the papers is discontinued due to the paper jam.

Figure 7:
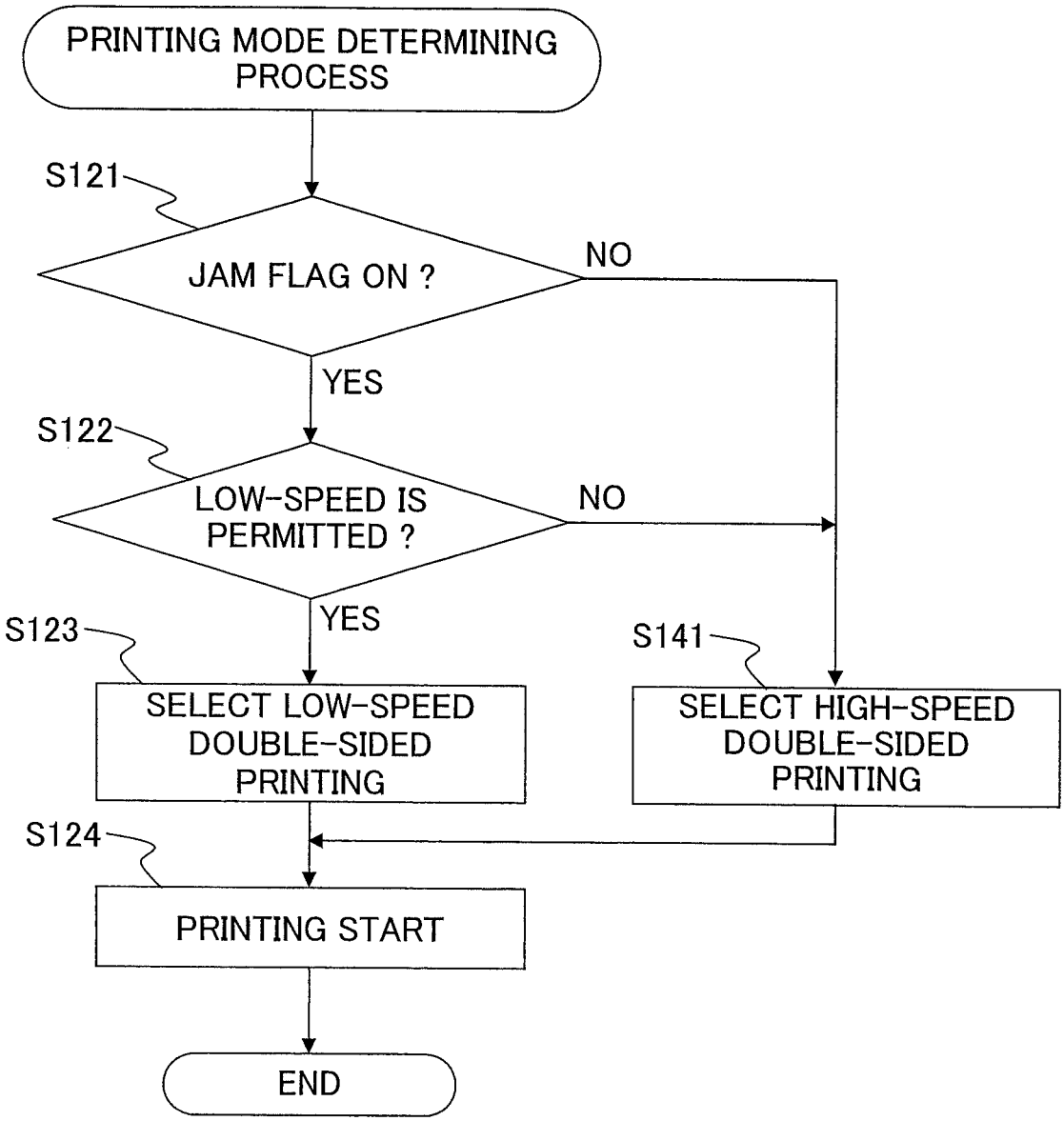
FIG. 7 is a flowchart showing a procedure (first embodiment) of a printing mode determining process.

Subsequently, an explanation will be made about a printing mode determining process executed by the CPU 31 of the printer 100, with reference to the flowchart shown in FIG. 7. The printing mode determining process is executed in a state that the transportation of the papers is executable, whenever the presence of printing data in which an expansion is completed is detected. The detection of the printing data is performed periodically (for example, every 100 ms).

At first, it is judged as to whether or not the jam flag is turned on (S121). As described above, the jam flag is turned on when the paper jam occurs. Accordingly, the jam flag is turned on when the printer 100 is recovered from the paper jam other than the pickup error. In other words, the jam flag is turned off during the normal operation.

When the jam flag is turned off (S121: NO), the normal operation is continued. Therefore, the high-speed double-sided printing is selected (S141). The transportation of the papers is started by the high-speed double-sided printing (S124), and the printing mode determining process is completed.

On the other hand, in a case that the jam flag is turned on (S121: YES), it is judged as to whether or not the resumption by the low-speed double-sided printing is permitted (S122). In a case that the resumption by the low-speed double-sided printing is permitted (S122: YES), the low-speed double-sided printing is selected (S123). The printing is started by the low-speed double-sided printing (S124), and the printing mode determining process is completed.

In a case that the resumption by the low-speed double-sided printing is not permitted (S122: NO), the high-speed double-sided printing is selected (S141). The printing is started by the high-speed double-sided printing (S124), and the printing mode determining process is completed.

That is, in the printing mode determining process, when the jam flag is turned on and when the resumption by the low-speed double-sided printing is permitted, it is determined that the printing is resumed by the low-speed double-sided printing. Other than the above case, it is determined that the printing is resumed by the high-speed double-sided printing. Accordingly, when the printer 100 is recovered from the discontinuation due to the paper jam during the high-speed double-sided printing, and when the resumption by the low-speed double-sided printing is permitted, the printing is resumed by switching the high-speed double-sided printing to the low-speed double-sided printing.

Figure 8:
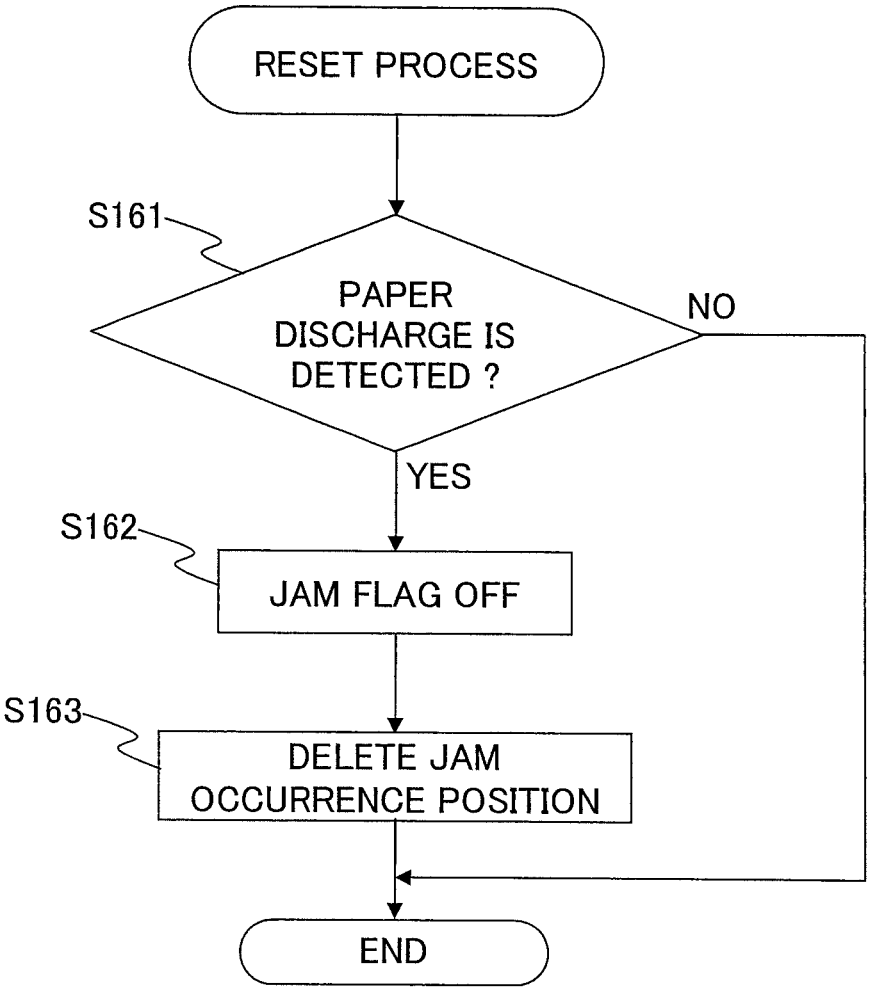
FIG. 8 is a flowchart showing a procedure (first embodiment) of a reset process.

Subsequently, an explanation will be made about a reset process executed by the CPU 31 of the printer 100, with reference to the flowchart shown in FIG. 8. After the transportation of the paper(s) is resumed in a state that the jam flag is turned on, the reset process is executed periodically (for example, every second) while the jam flag is turned on.

At first, it is judged as to whether or not the discharge of the paper is detected (S161). The discharge of the paper is detected, for example, when the paper for which the printing has been performed on both surfaces passes through the paper sensor 64 in the vicinity of the paper discharge rollers 76.

In a case that the discharge of the paper is detected (S161: YES), it can be judged that the paper fed after the resumption of the transportation of the paper(s) is transported without causing the paper jam again, that is, the recovery from the paper jam is successfully performed. Therefore, the jam flag is turned off (S162), and further, the information about the paper jam occurrence position is deleted (S163). After the S163, the reset process is completed.

On the other hand, in a case that the discharge of the paper is not detected (S161: NO), it can be judged that the paper fed after the resumption of the transportation of the paper(s) is still transported in the apparatus, or the paper cannot be transported due to the recurrence of the paper jam. Therefore, the reset process is completed without resetting the jam flag, etc.

That is, in the reset process, the jam flag is reset on condition that the discharge of the paper is detected. By doing so, in the printing mode determining process, the high-speed double-sided printing is selected for the papers fed after the jam flag is reset. That is, even when the printing is resumed by the low-speed double-sided printing, the printer 100 is capable of switching to the high-speed double-sided printing after the detection of the discharge of the paper.

Subsequently, an explanation will be made about a second embodiment of the recovery operation from the paper jam. In the second embodiment, the jam flag is reset on condition that the paper passes through the paper jam occurrence position. The second embodiment differs in this respect from the first embodiment in which the jam flag is reset after the discharge of the paper.

Figure 9:
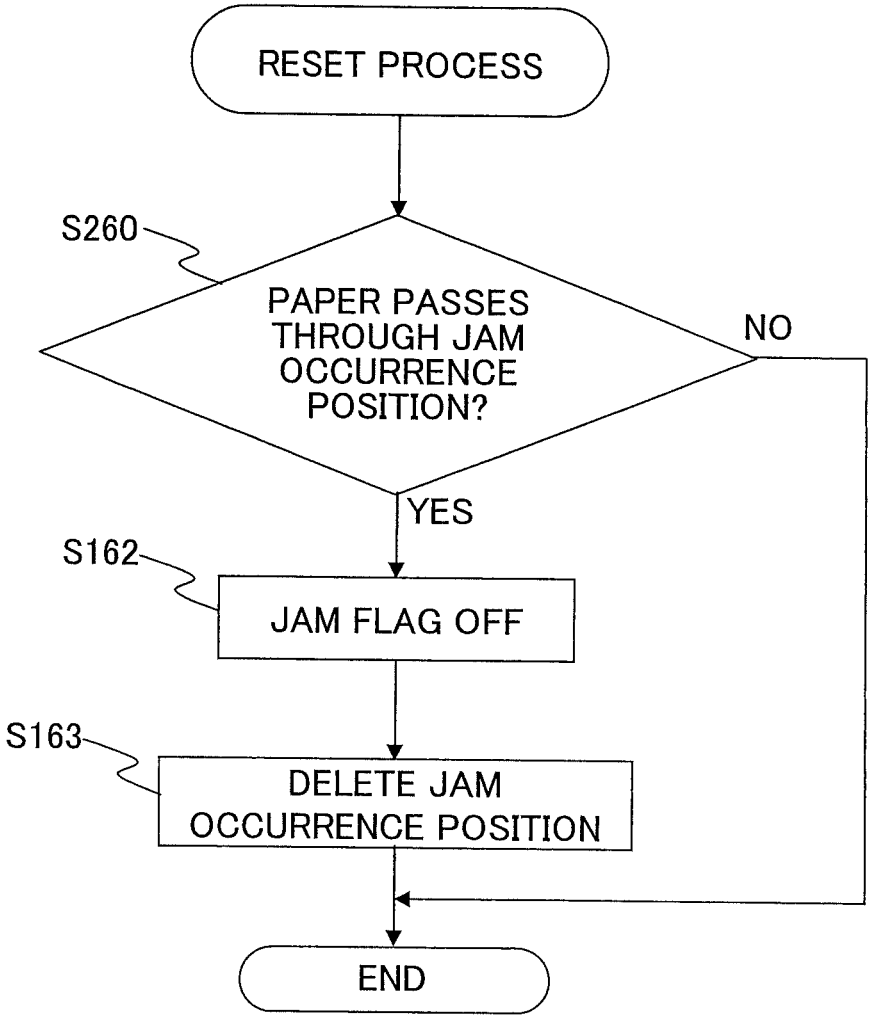
FIG. 9 is a flowchart showing a procedure (second embodiment) of the reset process.

At first, an explanation will be made about the reset process of the second embodiment with reference to the flowchart shown in FIG. 9. Note that, in the reset process of the second embodiment, processes which are same as or equivalent to those described in the first embodiment are designated by the same reference numerals.

At first, it is judged as to whether or not the paper passes through the paper jam occurrence position stored in the S103 (S260). That is, it is judged as to whether or not the paper sensor, which detected the paper jam, detects the passing of the paper. In a case that the passing of the paper is not detected (S260: NO), the reset process is completed without resetting the jam flag, etc.

In a case that the passing of the paper is detected (S260: YES), it can be judged that the paper fed after the resumption of the transportation of the paper(s) is transported without causing the paper jam again, that is, the recovery from the paper jam is successfully performed. Therefore, the jam flag is turned off (S162), and further, the information about the paper jam occurrence position is deleted (S163). After the S163, the reset process is completed.

Figure 10:
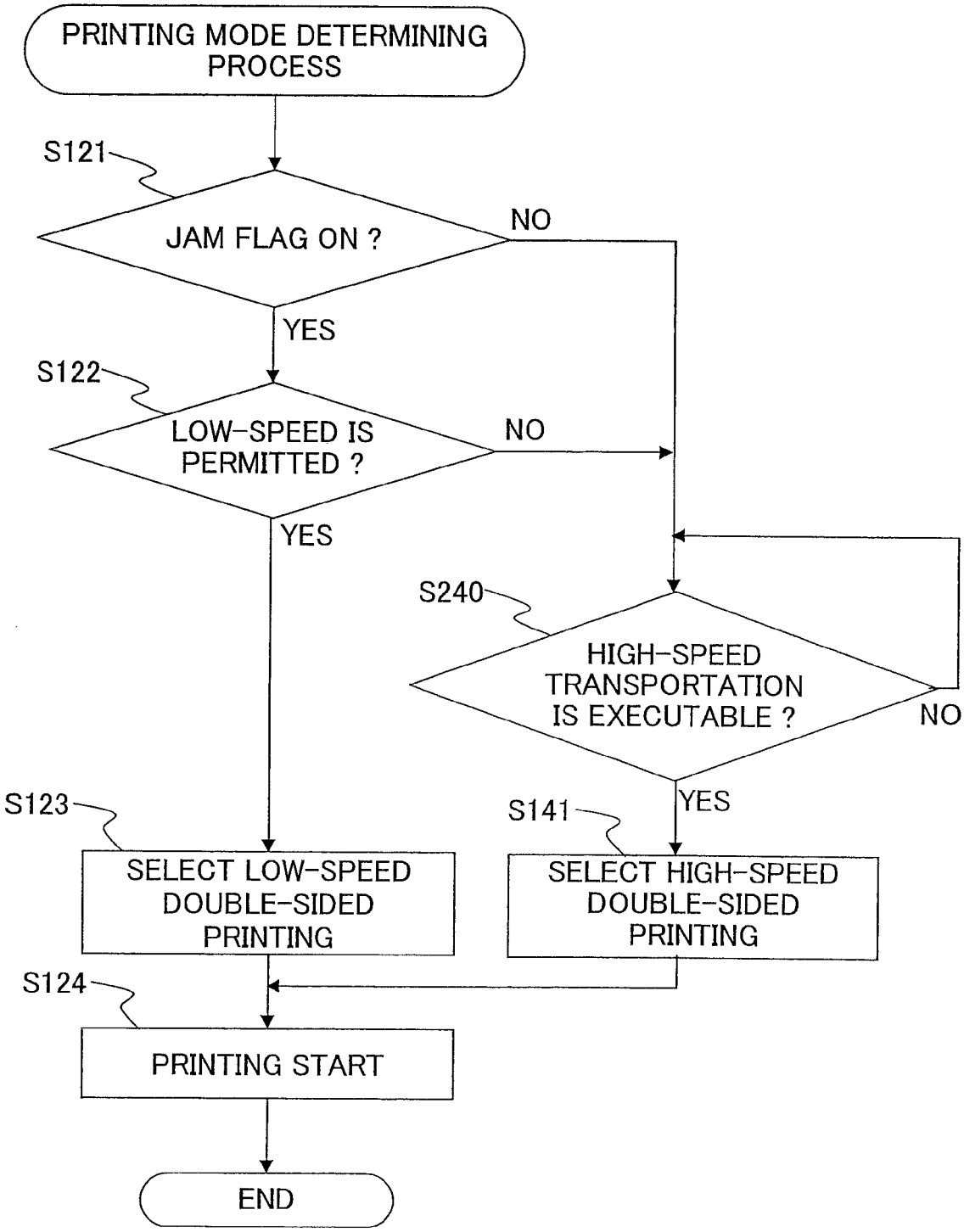
FIG. 10 is a flowchart showing a procedure (second embodiment) of the printing mode determining process.

Subsequently, an explanation will be made about the printing mode determining process of the second embodiment with reference to the flowchart shown in FIG. 10. Note that, in the printing mode determining process of the second embodiment, processes which are same as or equivalent to those described in the first embodiment are designated by the same reference numerals.

At first, it is judged as to whether or not the jam flag is turned on (S121). In a case that the jam flag is turned on (S121: YES), it is judged as to whether or not the resumption by the low-speed double-sided printing is permitted (S122). In a case that the resumption by the low-speed double-sided printing is permitted (S122: YES), the low-speed double-sided printing is selected (S123). Then, the printing is started by the low-speed double-sided printing (S124), and the printing mode determining process is completed.

On the other hand, in a case that the resumption by the low-speed double-sided printing is not permitted (S122: NO), or in a case that the jam flag is turned off (S121: NO), it is judged as to whether or not the switching to the high-speed double-sided printing is executable (S240).

Figure 11A:
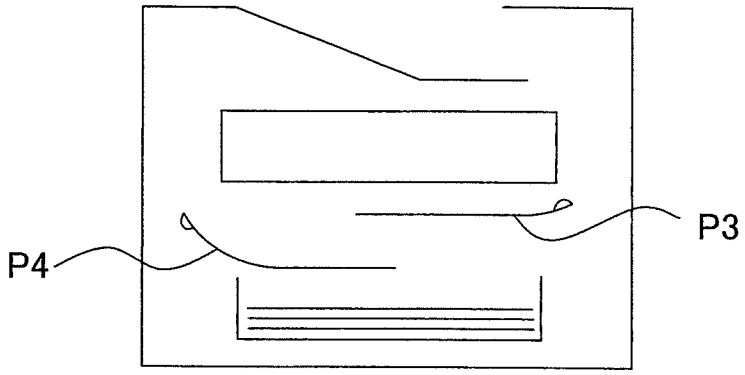
FIGS. 11A and 11B are diagrams showing an outline of a case in which an inconvenience arises during a switching operation between the paper transport modes.
Figure 11B:
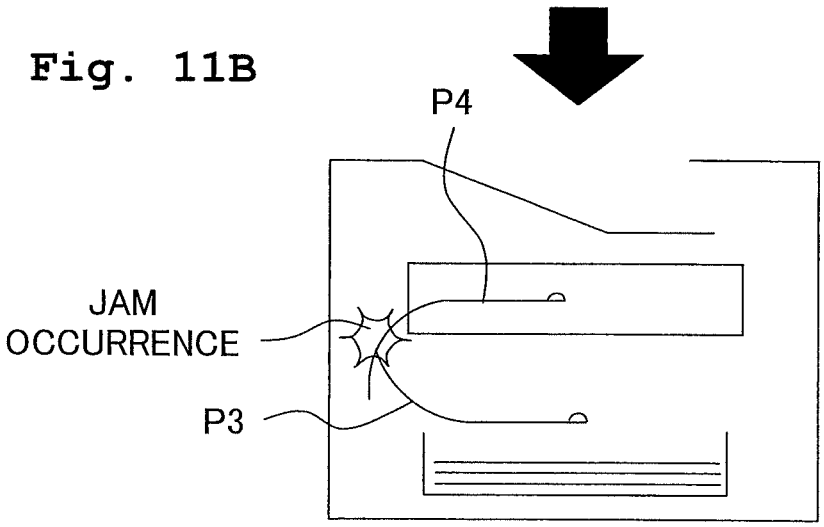

That is, if the switching between the paper transport modes is performed in a state that there is/are the paper(s) transported in the printer, any inconvenience arises in some cases. For example, it is assumed that the paper jam occurrence position is in the re-transport route 12. In that case, as shown in FIG. 11A, when the printing of the paper P4 by the high-speed double-sided printing is started immediately after the paper P3, which is printed by the low-speed double-sided printing, passes through the paper jam occurrence position, the paper P3 which is returned to the printing route 11 to be printed on the second surface is sometimes overlapped with the paper P4 which is newly fed, as shown in FIG. 11B. Therefore, in order to avoid such an inconvenience, in a case that the switching to the high-speed double-sided printing is unexecutable, that is, in a case that the preceding paper P3 is overlapped with the paper newly fed P4, or that a spacing distance between the preceding paper and the paper newly fed is extremely short (S240: NO), the feeding of the paper P4 is made to wait until the high-speed double-sided printing is executable. In other words, the feeding of the paper P4 is made to wait until the printing on the second surface of the paper P3 is completed and the paper P3 is discharged on the discharge tray 96.

In a case that the switching to the high-speed double-sided printing is executable (S240: YES), the high-speed double-sided printing is selected (S141). Then, the printing by the high-speed double-sided printing is started (S124) and the printing mode determining process is completed.

That is, in the second embodiment, the jam flag is reset without waiting the discharge of the paper under the condition that the paper passes through the paper jam occurrence position. Further, the printing mode is switched to the high-speed double-sided printing after the transportation of the papers by the high-speed double-sided printing becomes executable. By doing so, as compared with the first embodiment, it is possible to resume the high-speed double sided printing at an earlier stage.

As described in detail above, when the paper jam occurs in the printer 100 of this embodiment during the high-speed double-sided printing (the example of the first transport mode) in which the maximum number of the papers to be transported is large, the printing is resumed, upon completion of the recovery operation, by the low-speed double-sided printing (the example of the second transport mode) in which the maximum number of the paper(s) to be transported is small. By doing so, even if the paper jam recurs during the low-speed double-sided printing after the recovery, the number of the paper(s) stayed in the printer is small as compared with the case in which the printing is resumed by the high-speed double-sided printing. Therefore, it is possible to reduce any trouble in the recovery operation.

It is noted that this embodiment is provided merely as an example, and the present teaching is not limited thereto. Therefore, it is needless to say that various modifications which fall within the basic teaching herein set forth may be made to the present teaching. For example, the present teaching is applicable, without being limited to the printer, to those which include the printing function, such as multifunction machines, facsimile apparatuses, etc. Further, the image forming type of the process section may be an ink-jet type without being limited to the electro-photographic type. Furthermore, the printing apparatus may form either a color image or a monochrome (black and white) only.

In the high-speed double-sided printing of the above embodiments, the printing on the first surface of the paper is continuously performed on two sheets and then the printing on the second surface of the paper is continuously performed on the two sheets. However, the number of papers to be continuously printed is not limited to two. The maximum value of the number of papers to be continuously printed varies according to the maximum number of papers to be transported. The maximum number of papers to be transported is determined by the length of the transport route, the length of the paper in the transporting direction, etc. That is, the number of papers to be continuously printed is not limited to two described above, and may be three or more. Further, in the low-speed double-sided printing in the embodiments, the number of papers to be continuously printed is one. However, the number of papers to be continuously printed in the low-speed double-sided printing may be two or more provided that the number of papers to be continuously printed in the high-speed double-sided printing is three or more and that the number of papers to be continuously printed in the low-speed double-sided printing does not exceed the number of papers to be continuously printed in the high-speed double sided printing.

In the transporting example of the high-speed double-sided printing according to the embodiments, the printing on the first surface of the paper is continuously performed on two sheets and then the printing on the second surface of the paper is continuously performed on the same number of sheets. However, it is allowable that the printing on the first surface of the paper is continuously performed on a plurality of sheets and then the printing on the first surface and the printing on the second surface are alternately performed. For example, it is allowable that the number of papers to be continuously printed at the start of the transportation of the papers is provided as two, and after the printing on the first surface of the paper is continuously performed on two sheets, the printing on the first surface and the printing on the second surface are alternately performed. In that case, for example, when the double-sided printing is performed on four papers, the printing is performed in order of the first surface (first paper), the first surface (second paper), the second surface (first paper), the first surface (third paper), the second surface (second paper), the first surface (fourth paper), the second surface (third paper), the second surface (fourth paper). The present teaching is also applicable to this transporting process.

The printer 100 of the embodiments includes the transport mechanism which is capable of performing the double-sided printing. However, the printer 100 is not limited to the printer which is capable of performing the double-sided printing. For example, even if the printer is a printer provided with a transport mechanism which does not support the double-sided printing, the present teaching is applicable, provided that this printer includes a high-speed transport mechanism which transports a plurality of papers continuously to a transport route so that the plurality of papers are present in the transport route and that this printer supports at least two transport modes having different maximum numbers of the papers to be transported from each other.

The printer 100 of the embodiments is allowed to return to the high-speed double-sided printing, when the paper P3, which is fed first after the printing mode is switched to the low-speed double-sided printing, is discharged (first embodiment) or passes through the paper jam occurrence position (second embodiment). However, the present teaching is not limited thereto. For example, the printer 100 may be allowed to return to the high-speed double-sided printing when a predetermined number of papers are discharged or pass through the paper jam occurrence position.

The printer 100 of the embodiments is allowed to switch to the high-speed double-sided printing in a case that the low-speed double-sided printing is successfully performed. However, it is not necessarily indispensable that the printer is allowed to return to the high-speed double-sided printing. That is, even if the printer is left in the low-speed double-sided printing mode, there is the effect for reducing any trouble of the recovery operation in the case of recurrence of the paper jam.

The printer 100 of the embodiments supports only two transport modes including the high-speed double-sided printing in which the maximum number of papers to be transported is two and the low-speed double-sided printing in which the maximum number of paper(s) to be transported is one. However, the printer 100 may support transport modes not less than three provided that a super high-speed double-sided printing in which the maximum number of papers to be transported is not less than three is executable. In that case, the printing may be resumed by the high-speed double-sided printing or the low-speed double-sided printing, provided that the paper jam occurs during the super high-speed double-sided printing. Further, when the printing is resumed by the low-speed double-sided printing upon completion of the recovery operation and when the transportation by the low-speed double-sided printing is performed successfully, the printing mode may be switched to the high-speed double-sided printing or the super high-speed double-sided printing. That is, either one of the high-speed double-sided printing and the super high-speed double-sided printing may be adopted, provided that the maximum numbers of papers to be transported in the high-speed double-sided printing and the super high-speed double-sided printing are both larger than that in the low-speed double-sided printing. In that case, the high-speed double-sided printing and the super high-speed double-sided printing are examples of a third transport mode.

The printer 100 of the embodiments has the setting which makes it impossible to resume the printing by the low-speed double-sided printing. However, this setting is not indispensable. That is, the printer 100 may be constructed such that, when the printer is recovered from the paper jam which occurs during the high-speed double-sided printing, the printing is always resumed by the low-speed double-sided printing.

In the printer 100 of the embodiments, the pickup error is shown as an example of the paper jam in which the switching to the low-speed double-sided printing is not performed. However, the present teaching is not limited thereto. For example, the printing route 11 and the re-transport route 12 include a position at which the paper is easily removed (for example, a position close to the cover) and a position at which the paper is removed with difficulty (for example, a position far from the cover). Since the recovery operation is easily performed at the position at which the paper is easily removed, it is not likely that the scrap of the paper, etc., is stayed in the printer. Thus, the paper jam hardly recurs. In view of this, it is allowable that, when the paper jam occurs at the position at which the paper is easily removed, the switching to the low-speed double-sided printing is not performed.

What is claimed is:

1. A printing apparatus, comprising:

a printing section configured to print an image on a paper at a printing position;

a paper feed section configured to hold papers to be printed by the printing section;

a paper discharge section configured to hold the papers that have been printed by the printing section;

a transport route which extends from the paper feed section to the paper discharge section via the printing position;

a transport mechanism configured to transport the papers along the transport route;

a pickup mechanism which is provided on the transport route between the paper feed section and the printing section, and which is configured to pick up the paper from the paper feed section;

a first paper sensor which is provided on the transport route between the pickup mechanism and the printing section, and which is configured to detect passing of the papers;

a second paper sensor which is provided on the transport route between the first paper sensor and the paper discharge section, and which is configured to detect passing of the papers; and a controller configured to control the transport mechanism, the printing section, and the pickup mechanism to perform a printing operation by a plurality of printing modes including a first printing mode and a second printing mode, the first printing mode being a mode in which the transport mechanism transports the papers so that at most a first number of papers are present in the transport route and the printing section prints images on the papers transported through the printing position, and the second printing mode being a mode in which the transport mechanism transports the papers so that at most a second number, which is smaller than the first number, of the papers are present in the transport route and the printing section prints images on the papers transported through the printing position;

wherein the controller is further configured to:

in a case that the controller determines that the paper jam occurs based on the detection result of the second paper sensor while the controller performs the printing operation by the first printing mode, stop the printing operation until the paper jam has cleared, select the second printing mode as the printing mode for resuming the printing operation, resume the printing operation by the second printing mode after the paper jam has cleared, and after at least one paper has passed through the paper jam occurrence position or has discharged to the paper discharge section after resuming the printing operation, switch the printing mode from the second printing mode to a different printing mode, said different printing mode may be the first printing mode or may be different from the first printing mode;

in a case that the controller determines that the paper jam occurs based on the detection result of the first paper sensor while the controller performs the printing operation by the first printing mode, stop the printing operation until the paper jam has cleared, select the first printing mode as the printing mode for resuming the printing operation, and resume the printing operation by the first printing mode after the paper jam has cleared.

2. The printing apparatus according to claim 1, wherein the different printing mode is a third printing mode in which the transport mechanism transports the papers so that at most a third number, which is larger than the second number, of the papers are present in the transport route, after the transportation of the papers is resumed by the second printing mode, in a case that at least one paper of the papers placed on the paper feed section is transported without causing the paper jam in the transport route, the controller controls the transport mechanism to switch the printing modes from the second printing mode to the third printing mode.

3. The printing apparatus according to claim 2, further comprising an identification mechanism which identifies a paper jam occurrence position at which the paper jam occurs in the transport route, wherein after the transportation of the papers is resumed by the second transport mode, in a case that the at least one paper passes through the paper jam occurrence position, the controller controls the transport mechanism to switch the transport modes from the second transport mode to the third transport mode.

4. The printing apparatus according to claim 3, wherein the transport route includes a printing route which guides the papers fed from the paper feed section to the printing position and a re-transport route which guides the papers having passed the printing position back to the printing route so that the papers having passed the printing section are reversed and guided to the printing position again;

the first transport mode, the second transport mode, and the third transport mode are the transport modes in which double-sided printings utilizing the re-transport route are performed; and in a case that the transport modes are switchable from the second transport mode to the third transport mode at a time at which the at least one paper passes through the paper jam occurrence position after the transportation of the papers is resumed by the second transport mode, the controller controls the transport mechanism to switch the transport modes from the second transport mode to the third transport mode.

5. The printing apparatus according to claim 4, wherein the transport modes are switchable from the second transport mode to the third transport mode at the time at which the at least one paper passes through the paper jam occurrence position, in a case that the at least one paper is not overlapped with another paper which is to be transported by the third transport mode on the transport route.

6. The printing apparatus according to claim 4, wherein in a case that the paper jam occurrence position is on the re-transport route, the controller controls the transport mechanism to keep the second transport mode until the at least one paper is discharged to the discharge section without causing the paper jam in the transport route.

7. The printing apparatus according to claim 2, wherein after the transportation of the papers is resumed by the second printing mode, and in a case that at least one paper of the papers placed on the paper feed section is discharged to the paper discharge section without causing the paper jam in the transport route, the controller controls the transport mechanism to switch the printing modes from the second printing mode to the third printing mode.

8. The printing apparatus according to claim 1, further comprising a memory in which settings are stored, the settings being as to whether or not to switch the printing modes in a case that the paper jam occurs in the transport route during the transportation of the papers by the first printing mode to thereby discontinue the transportation of the papers, wherein in a case that a setting to switch the printing modes is stored in the memory, the controller controls the transport mechanism to switch the printing modes.

9. The printing apparatus according to claim 1, wherein after the printing operation is resumed by the second printing mode, in a case that at least one paper of the papers placed on the paper feed section is transported without causing the paper jam in the transport route, the controller controls the transport mechanism and the printing section to switch the printing modes from the second printing mode to the first printing mode.

* * * * *